United States Patent [19]

Bieri

[11] 4,178,991

[45] Dec. 18, 1979

[54] HEAT EXCHANGER AND A HEAT EXCHANGER ELEMENT THEREFOR

[75] Inventor: Hans Bieri, Dietikon, Switzerland

[73] Assignee: Sulzer Brothers Ltd., Winterthur, Switzerland

[21] Appl. No.: 729,978

[22] Filed: Oct. 6, 1976

[30] Foreign Application Priority Data

Jul. 30, 1976 [CH] Switzerland ..... 9754/76

[51] Int. Cl.[2] ..... F28F 3/02

[52] U.S. Cl. ..... 165/166

[58] Field of Search ..... 165/156, 165, 166, 163, 165/170, 183, 152, 153, 167, 169; 432/223

[56] References Cited

U.S. PATENT DOCUMENTS

| | | | |
|---|---|---|---|
| 574,157 | 12/1896 | Ljungstrom | 165/166 |
| 2,136,086 | 11/1938 | Rosenblad | 165/166 |
| 2,498,372 | 3/1970 | Patten et al. | 165/166 |
| 2,657,018 | 10/1953 | Simbelaar | 165/170 |
| 3,111,982 | 11/1963 | Ulbricht | 165/166 |

FOREIGN PATENT DOCUMENTS

| | | | |
|---|---|---|---|
| 641574 | 5/1962 | Canada | 165/165 |
| 745914 | 3/1956 | United Kingdom | 165/156 |

*Primary Examiner*—Ronald H. Lazarus
*Assistant Examiner*—Theophil W. Streule, Jr.
*Attorney, Agent, or Firm*—Kenyon & Kenyon

[57] ABSTRACT

The heat exchanger element is constructed with radially disposed walls so as to sub-divide the element into flow zones with alternating zones carrying first and second heat-exchange media. The alternating zones convey the media in opposite directions to carry out the heat exchange. The walls may be of flat shape disposed in a radial pattern or may be formed of corrugated plates interspaced between flat walls.

11 Claims, 14 Drawing Figures

FIG. 1
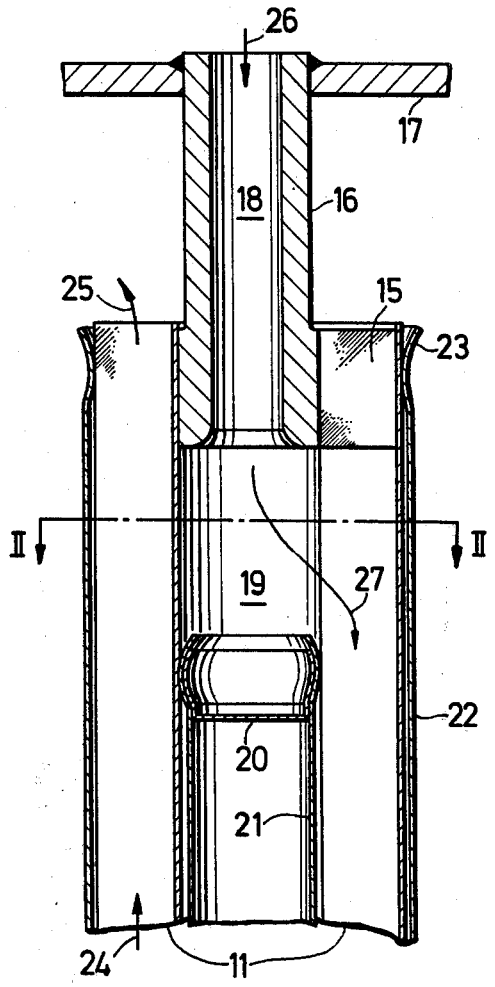
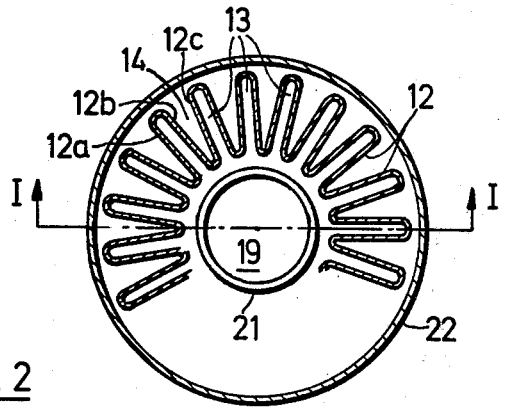
FIG. 2

HEAT EXCHANGER AND A HEAT EXCHANGER ELEMENT THEREFOR

This invention relates to a heat exchanger and a heat exchanger element therefor.

As is known, various types of heat exchangers have been known in which flowable media can be placed in heat exchange relation with each other. However, in many instances, the various heat exchangers have not been able to handle large flow rates while at the same time providing low construction and maintenance costs.

Accordingly, it is an object of the invention to provide a heat exchanger which is suitable for large flow rates of heat exchange media and which can be produced at relatively low cost.

It is another object of the invention to provide a heat exchanger element which requires minimal maintenance.

It is another object of the invention to provide a heat exchanger element which has low flow losses.

It is another object of the invention to provide a heat exchanger element which is of compact construction.

Briefly, the invention provides a heat exchanger element which has a plurality of radially disposed walls which extent from a longitudinally disposed central area. In one embodiment, each of the walls is connected at an inner radial end to an adjacent wall and at an outer radial end to another adjacent wall to define flow zones on opposite sides of each wall. In addition, means are provided to close the alternating flow zones to the remaining flow zones so as to form separate flow paths for the two heat exchange media on opposite sides of each wall.

In one embodiment, at least every second of the walls of the heat exchange element which follow each other in the circumferential direction is corrugated (wavy) the crests running in the direction of the longitudinal axis of the exchanger. A relatively very large heat exchange area can thus be accommodated relative to the external dimensions of the heat exchanger while advantageous flow conditions are maintained for both media. In this connection, an embodiment which is particularly well suited for taking up pressure differences between the two media can be obtained by providing one uncorrugated flat wall between two separate walls with the crests and the troughs of the corrugated walls braced against an uncorrugated wall.

To achieve optimum heat exchange conditions over the entire radial extent in the flow area, it is further advisable to increase the height of the crests as the distance from the central area increases and to decrease the wave length conversely. By means of these measures, the flow zones are divided over the entire radial extent into individual sections with approximately the same hydraulic radius. This results in uniform conditions for the heat exchange.

The walls, which start out from the central area of the exchanger in radial fashion may also be curved in the manner of involutes. In this case, two walls always follow each other immediately in the circumferential direction and enclose flow zones over their entire radial extent which have substantially the same geometrical character transverse to the longitudinal axis of the exchanger. Such an embodiment makes it possible to provide uniform corrugation for the walls and to have the entire available cross section occupied by flow zones of equal cross section for the two media.

These and other objects and advantages of the invention will become more apparent from the following detailed description and appended claims taken in conjunction with the accompanying drawings in which:

FIG. 1 illustrates a partial longitudinal cross section through a heat exchanger according to the invention;

FIG. 2 illustrates a view taken on line II—II of FIG. 1;

Figure 3:
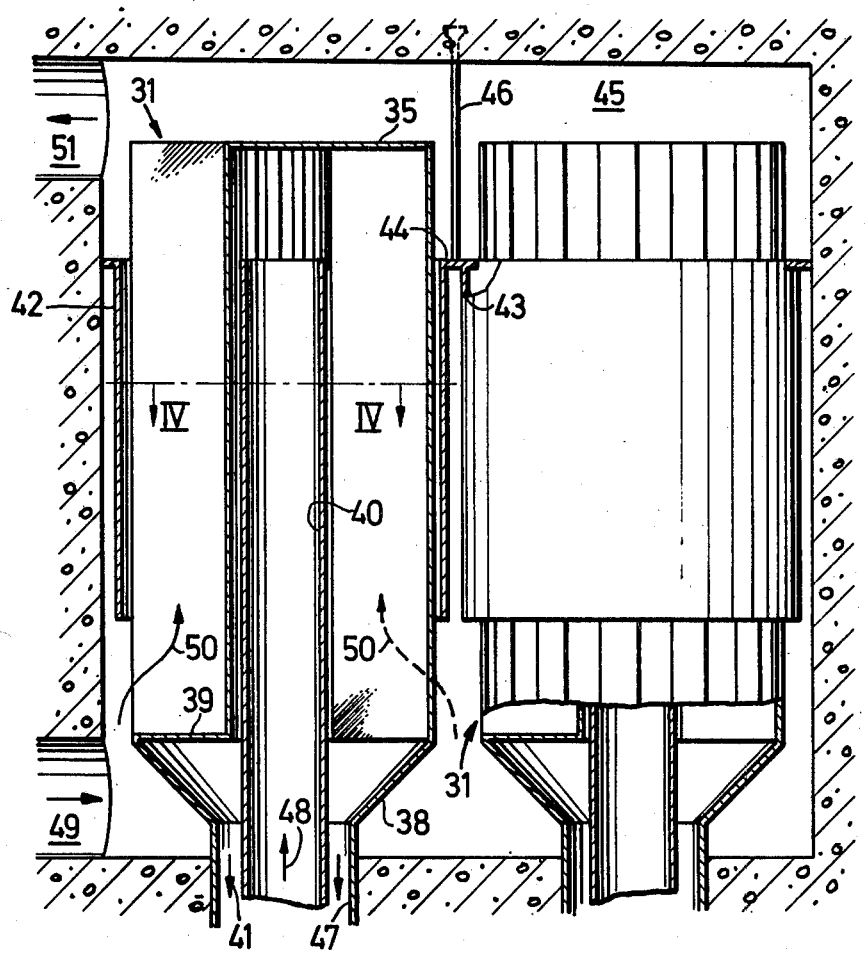
FIG. 3 illustrates two heat exchanger units, partially in view and partially in a longitudinal cross section, built into a masonry chamber for conducting one heat exchange medium in accordance with the invention.

Referring to FIGS. 1 and 2, the heat exchanger comprises a heat exchanger element 11 which is formed in substance by walls 12 which start out in radial fashion from a central area of the exchanger. The central region, from which the walls 12 start out, extends along the longitudinal axis of the exchanger. Individual succeeding walls, e.g. 12*a*, 12*b*; 12*b*, 12*c* are joined to each other in an alternating fashion wherein each wall is connected at an inner radial end to an adjacent wall and at an outer radial end to another adjacent wall to define flow zones on opposite sides of each wall for two heat exchange media. These walls 12 thus form a star-like cross section. The row of connected walls can be produced, e.g. by folding a strip and/or by joining several walls by welding or by one or several beading operations with subsequent soldering.

As shown, the walls 12*a* and 12*b* form one flow zone 13 while the walls 12*b* and 12*c* from a second flow zone 14. These zones are associated alternatiingly with one or the other medium. For this purpose, all the flow zones 13 are closed off at the two ends of the exchanger in the lengthwise direction by means of a correspondingly shaped plate means 15 which join tightly to the walls 12 by means of a high-melting solder. This plate means 15 is continued in a connecting stub 16 which extends from the central area of the element 11. The stub 16 is, in turn, welded to a tube sheet 17 along with several other like elements (not shown). Each stub 16 has a flow duct 18 which opens into a central chamber 19. This chamber 19 is closed off at the bottom by a cup-like member 20 which is inserted into the end of a tubular guide body 21 coaxial of the element 11 and is plastically deformed by a rolling operation in such a manner that the guide tube 21 is clamped into the inner joints of the walls 12. An outer tube 22 encloses the heat exchanger element 11 and is joined to the element 11 by a rolling operation in the region of one end portion 23.

In operation, one of the participating media flows in the direction indicated by the arrows 24, 25 (FIG. 1) in the space between the outer tube 22 and the element 11 formed by the walls 12 through the flow zones 14 between the walls 12. The other medium participating in the exchange flows in the direction indicated by the arrows 26, 27 through the duct 18 of the stub 16 into the chamber 19 and from there into the flow zones 13 of the element 11. Discharge takes place at the other end (not shown) of the heat exchanger via a connecting stub like stub 16 which is welded into a second tube sheet (not shown).

Figure 4:
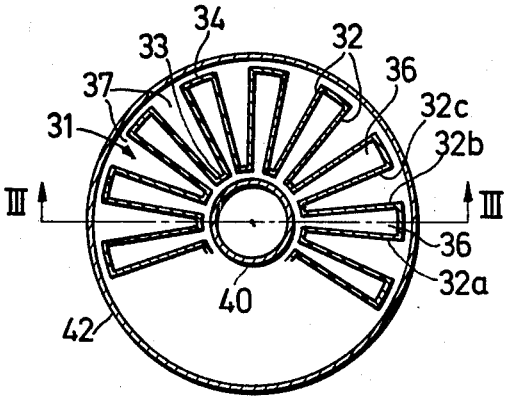
FIG. 4 illustrates a view taken on line IV—IV of FIG. 3.

Referring to FIGS. 3 and 4, the heat exchanger has upright heat exchange elements 31 which are formed by sharply angled sheet metal. The walls 32 which start out from a central area of the element in radial fashion form a profile, together with the inner and outer wall parts 33 and 34, which is closed off at the upper end by a plate means 35 which covers only the inside area of the profile. The walls 32 which follow each other in the circumferential direction, e.g. the walls **32*a*, 32*b*, 32*c*, enclose flow zones 36 and 37, through which the one and the other medium flows, respectively. At the lower end, each heat exchanger element 31 is connected to a tubular cone 38 while plate means 39 fill the wedges between the outer contour of the element 31, i.e. tightly close off the flow zones 37** in the axial direction.

An inner guide tube 40 is disposed in the central area of the element 31 and serves as the connecting tube for the medium flowing through the zones 36. The middle portion of the element 31 is surrounded with little spacing by an outer guide tube 42. This guide tube 42 is closely joined to the guide tube 43 of an adjacent heat exchanger via straps 44 and is suspended in a chamber 45 containing the heat exchangers by means of tie rods 46. The element 31 is anchored in the bottom of the chamber 45 via the cones 38 and a connecting line 47.

As shown in FIG. 3, the guide tube 40 is leading from an inlet 48 to the upper end of the walls 32 for introducing a first flowable medium into the flow zones 36. The heat exchanger element has an outlet at the opposite end to exhaust said first medium. In similar fashion, a second inlet is provided at the lower end to the remaining flow zones 37 to introduce a second flowable medium and a second outlet is provided at the upper end of the flow zones 37 to exhaust the second flowable medium.

In operation, the one medium flows through the guide tube 40 upward in the direction indicated by the arrow 48 and passes laterally into the flow zones 36 of the element 31. After passing through the flow zones 36, the medium moves in the axial direction to flow off in the direction indicated by the arrow 41 through the annular space between the guide tube 40 and the connecting tube 47. The other medium flows through a duct 49 into the chamber 45 and further in the direction indicated by the arrows 50, into the flow zones 37 of the element 31 to flow off, after leaving the zones 37 through a duct 51.

It is a particular advantage of the embodiment as per FIGS. 3 and 4 that each heat exchanger unit consists of three structural parts mounted independently of each other. In this way, different temperatures cannot result in thermal stresses in an unfavorable manner. These structural parts are the outer guide tube 42 and 43, the inner guide tube 40 and the element 31 with the plate means 35 and 39.

Figure 5:
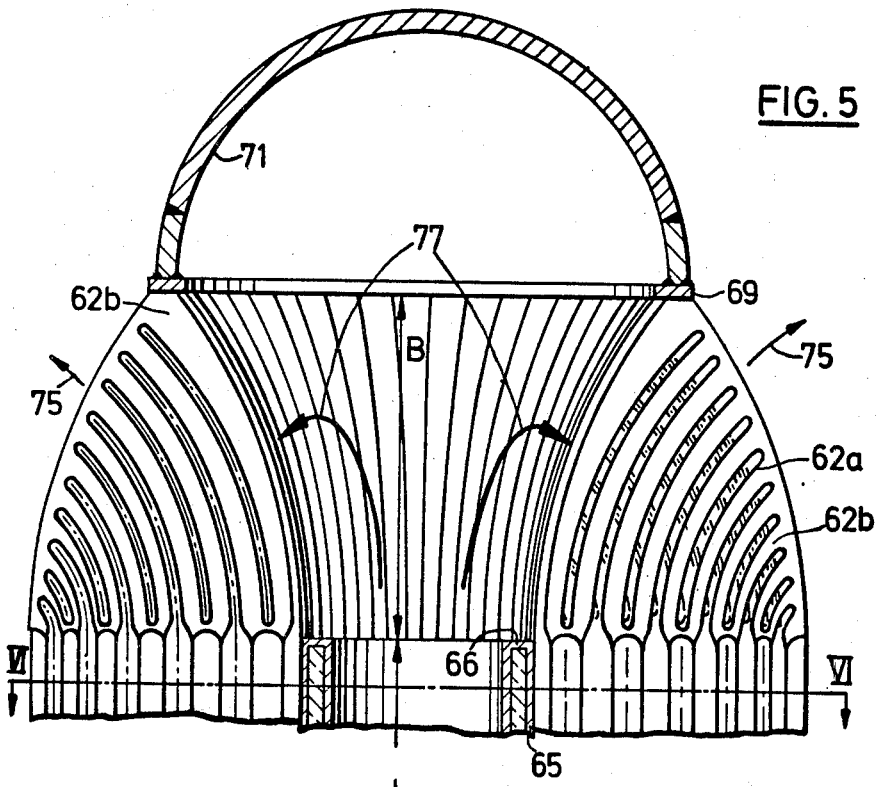
FIG. 5 illustrates a longitudinal cross sectional view through a further embodiment of a heat exchanger according to the invention.
Figure 6:
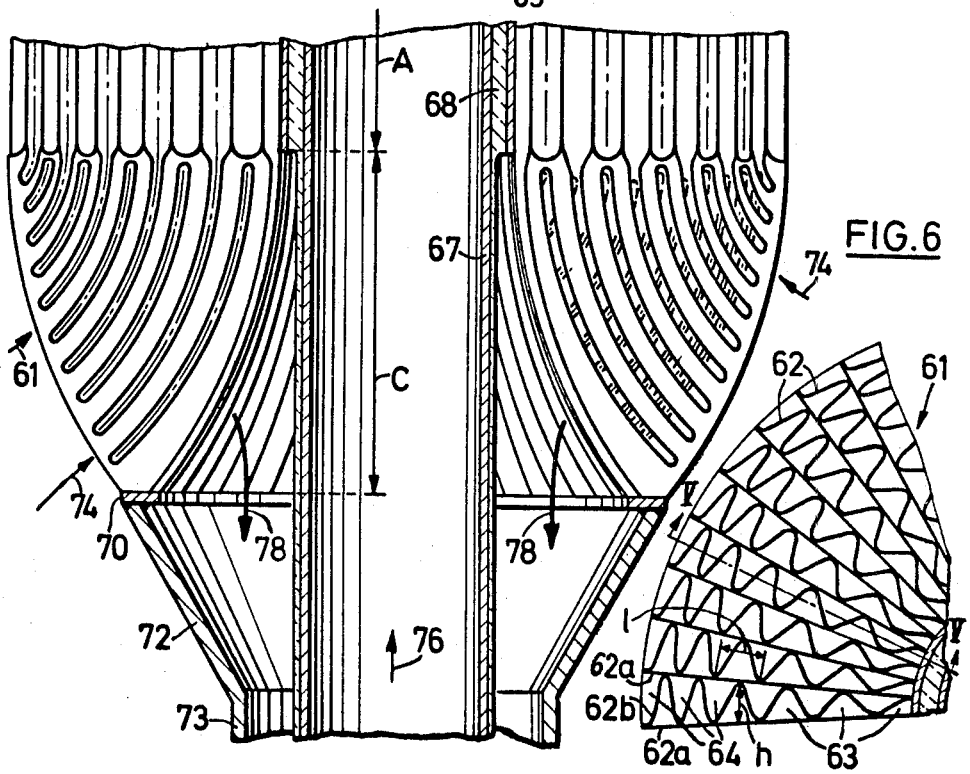
FIG. 6 illustrates a view taken on line VI—VI of FIG. 5.

Referring to FIGS. 5 and 6, the heat exchanger can be made for the purpose of enlarging the heat exchanger element without using appreciably more material while being usable for larger pressure differences. These effects are accomplished by providing the wall between the media participating in the heat exchange with corrugations. As illustrated in FIG. 6, a flat wall **62*a* starting out from a central area in radial fashion is followed in the central part A of the heat exchanger element 61 by a corrugated wall 62*b* and the corrugated wall 62*b*, in turn, by a flat wall 62*a*. The walls generally designated by 62 are fabricated of sheet metal. The walls 62*b* have crests which run in the direction of the longitudinal axis of the exchange element 61 and are produced, for instance, by deep-drawing. Both the crests and the troughs of the walls 62*b* and braced against the flat walls 62*a***. This results in an extraordinarily stiff and pressure-resistant construction.

The sheet metal parts **62*a* and 62*b* are welded together in the region of the middle part A alternatingly radially on the inside and radially on the outside. Thus, a single wall 62 is formed which is closed all around and which separates the flow zones 63 for the one medium from the respective adjacent flow zones 64** for the other medium.

The corrugations of the sheet metal parts **62*b* have wave heights h which increase with increasing distance from the central area; conversely, the wave length l decrease. In this manner, the hydraulic radius of the chambers 63 and 64** formed by the corrugated and flat wall is about the same, so that the same flow and heat transfer conditions can be obtained in the different chambers.

The star-shaped package of walls or laminations 62 is supported in the central region by a tube 65, which is connected via a ring 66 to the inner guide tube 67. An insulating material 68 is disposed between the tubes 65, 67 which is continued beyond the tube 65.

In the regions B and C, the walls **62*a* and 62*b* are cut in lancet-fashion and are provided with grooves which are curved outward in the walls 62*b* and inward in the walls 62*a* toward the central area of the element 61. The basic arrangement of these corrugations and grooves will be explained in detail in connection with the description of FIGS. 8 to 11**.

Referring to FIG. 5, the walls 62 are welded at the tips of the lancets to two rings 69, 70. The ring 69 is covered over by a spherical section 71 and serves to take up pressure force; for which purpose, a disk would be poorly suited in the presence of internal or external overpressure. The ring 70 is connected to an outer connecting tube 73 via a conical adapter 72.

In analogy to the flow conditions in the embodiment example as per FIGS. 3 and 4, the one medium flows in the direction indicated by the arrows 74 into the flow zones formed by the chambers 64 and flows out of the heat exchanger element 61 in the direction indicated by the arrows 75. The other medium flows upward in the direction indicated by the arrow 76 through the interior of the guide tube 67, to be distributed in the region of the exchanger part B in the direction indicated by the arrow 77 counterflow-wise to the first medium into the flow zones formed by the chambers 63. The second medium leaves the exchanger element 61 in the direction indicated by the arrows 78 through the space between the guide tube 67 on the one hand and the adapter 72 and the tube 73, on the other hand.

As shown in FIG. 3, two or more heat exchangers may be arranged close together. If the elements have a circular outline, flows through the spaces between the individual elements is prevented by guide tubes 42 and straps 66 or the like, in order to prevent undesirable bypass currents which do not participate in the heat exchange. Instead of using the outer guide tubes 42 as per FIG. 3, appropriately shaped fillers may be provided between the individual elements. Such fillers are obviated if the elements have, for instance, square or hexagonal outline, which permits dense, cell-like packing of a space corresponding to the chamber 45 in FIG. 3.

Figure 7:
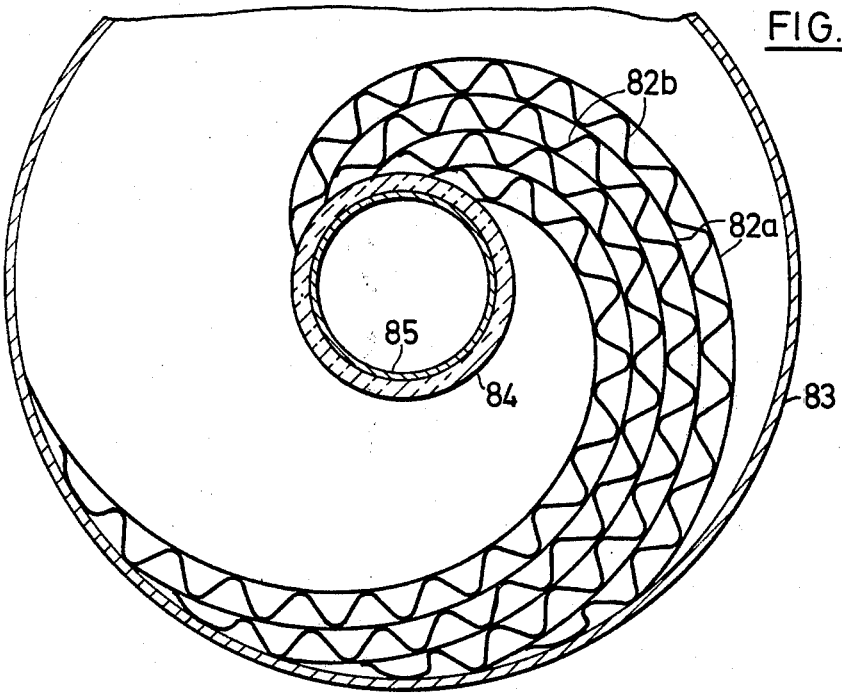
FIG. 7 illustrates a cross sectional view through a heat exchanger with corrugated walls disposed in involute-fashion.

FIG. 7 corresponds to a cross section, as shown in FIG. 6, through a heat exchanger as per FIG. 5. However, the walls 82*a* corresponding to the walls 62*a* no longer run in the radial direction, but in the direction of involutes. The walls 82*a* therefore have practically constant spacing over their entire extent. The walls 82*b* disposed between each two walls 82*a* are corrugated as per FIG. 6 and are supported by the walls 82*a*. This embodiment has the advantage that the deep-drawing properties of the sheet metal material can be utilized better because of the constant drawing depth over the entire radial extent.

Figure 8:
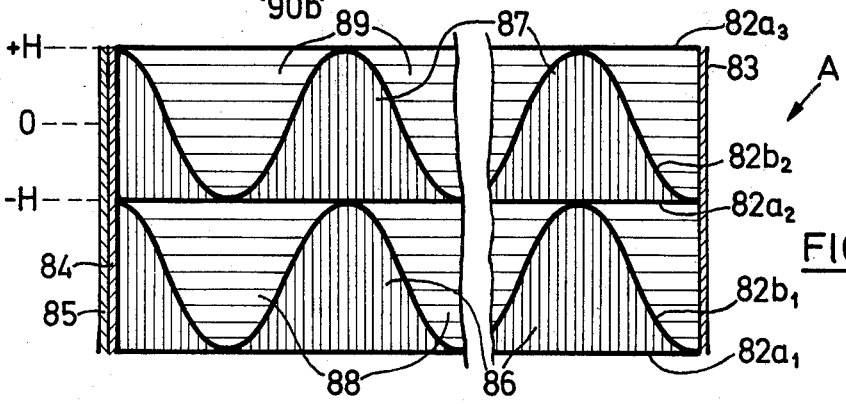

FIG. 8 depicts a partial cross section perpendicular to the longitudinal axis through the region A of the heat exchanger according to FIG. 5 under the assumption, however, that the exchanger is equipped with an exchanger element as per FIG. 7. In addition, the involute-shaped flow zones for the two media are shown schematically as developments. Thus, two adjacent flat walls $82a_1$, $82a_2$ appear in the cross section as a straight profile and two adjacent corrugated walls $82b_1$ and $82b_2$ as a sinusoidal profile. The walls 82 extend from a central area which is schematically indicated in the development by the tube 85 with insulation 84 to the peripheral area indicated by the wall 83. The walls $82a_1$ and $82b_1$ enclose a flow zone 86, indicated by vertical shading, for a first medium participating in the heat exchange. A corresponding flow zone 87 for the first medium is located between the walls $82a_2$ and $82b_2$. For the second medium, the walls $82b_1$ and $82a_2$ form a flow zone 88 and the walls $82b_2$ and $82a_3$ a flow zone 89. The last-mentioned zones are marked by horizontal shading. It is assumed that the sinusoidal walls 82*b* rise and fall alternatingly from a mean level 0 to the height +H or −H, respectively.

Figure 9:
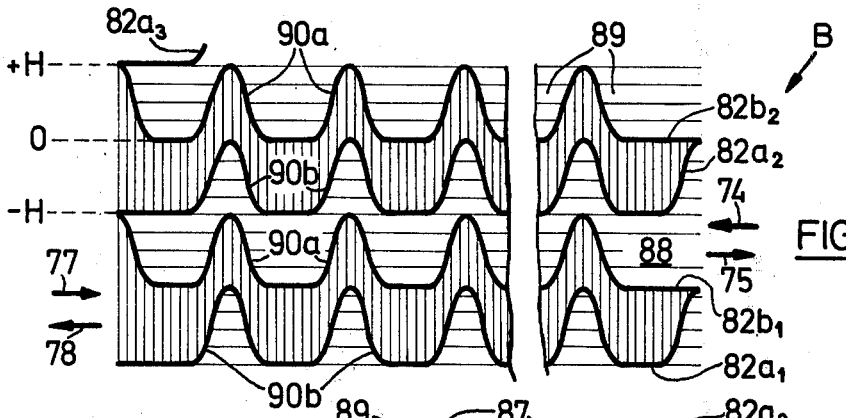
FIGS. 8, 9, 10 and 11 illustrate, schematically, the arrangement and shape of walls disposed in radial fashion which can be used with appropriate adaptations in arrangements according to FIGS. 5, 6, 7.

In the region B and C (FIG. 5), the profiles of the sheet metal walls 82*a* and 82*b* change. The walls 82*b* are, as illustrated in FIG. 9, mainly at the level 0, from which elevations defined by grooves 90*a* rise up to the height +H. The walls 82*a* are mainly at the level −H and have elevations defined by grooves 90*b* which rise to the level 0. The grooves of adjacent walls are mutually crossing, what is not to be seen in FIG. 9, so the walls are braced against each other also in the regions B and C.

In the regions B and C, in which the exchanger element is no longer confined in the central area by the guide tube 85, the wall $82b_1$ and the wall $82a_2$ are tightly joined together at the inner edge and likewise the walls $82b_2$ and $82a_3$. On the entire sides facing the central area, these joints end at the level +H if the main level of a wall 82*b* is assumed as the mean level 0. Vice versa, the walls $82a_1$ are tightly joined to the walls $82b_1$ on the outer periphery and the wall $82a_2$ to the wall $82b_2$, and specifically, in the regions B and C at the level 0 and in the region A at the level −H. The flow zones 86 and 87 (vertical shading) described for region A (FIG. 8) therefore open in the regions B and C toward the central portion of the exchanger, i.e. in the zone 86 and 87, the respective medium can flow in or out in the direction indicated by the arrows 77 and 78, respectively (FIG. 5 and 9). In contrast thereto, the flow zones 88, 89 for the other medium (horizontal shading) are closed off on the whole inside and open up at the outer circumference in the regions B and C; for these flow zones the respective medium can therefore flow in or out in the directions indicated by the arrows 74, 75 (FIG. 5).

Figure 10:
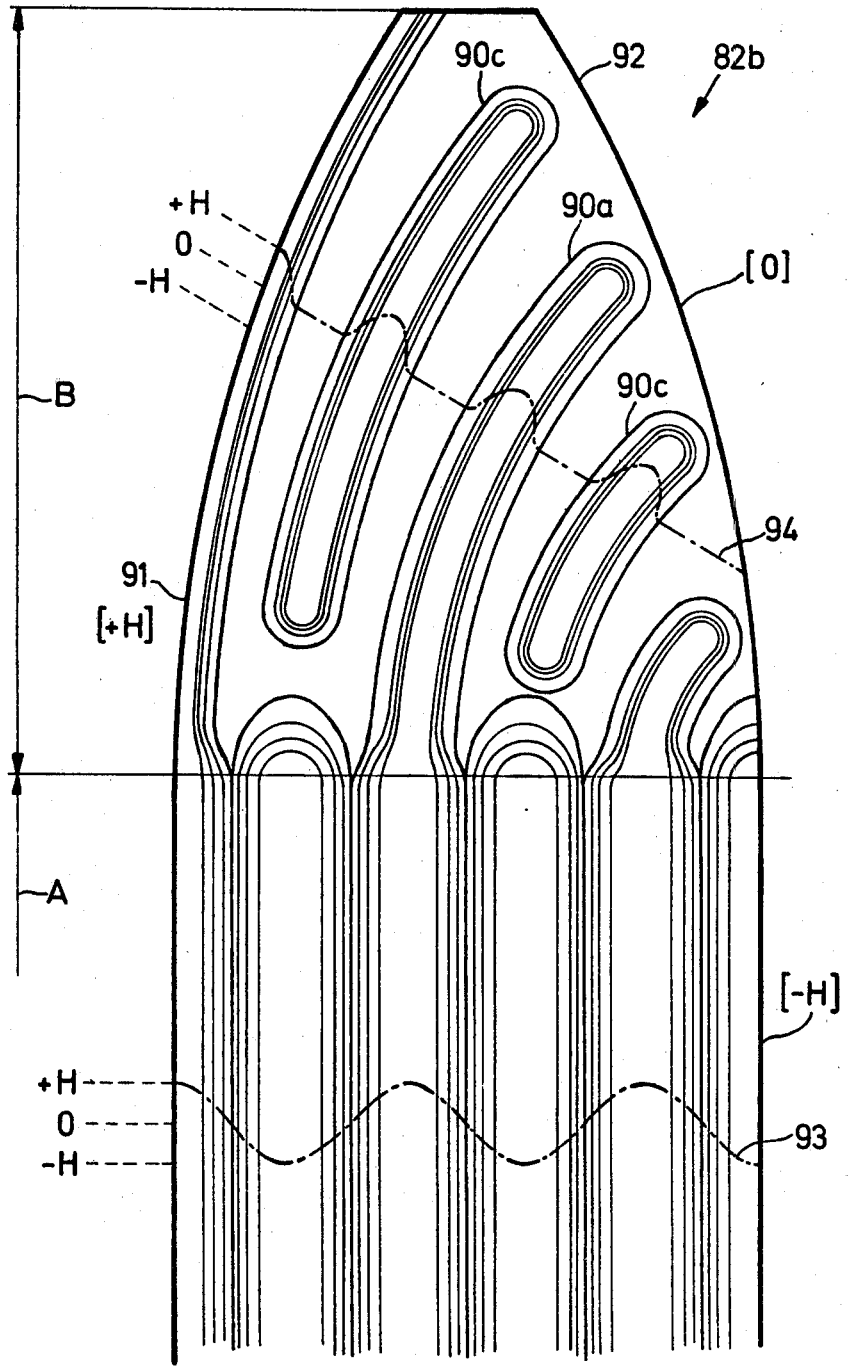
Figure 13:
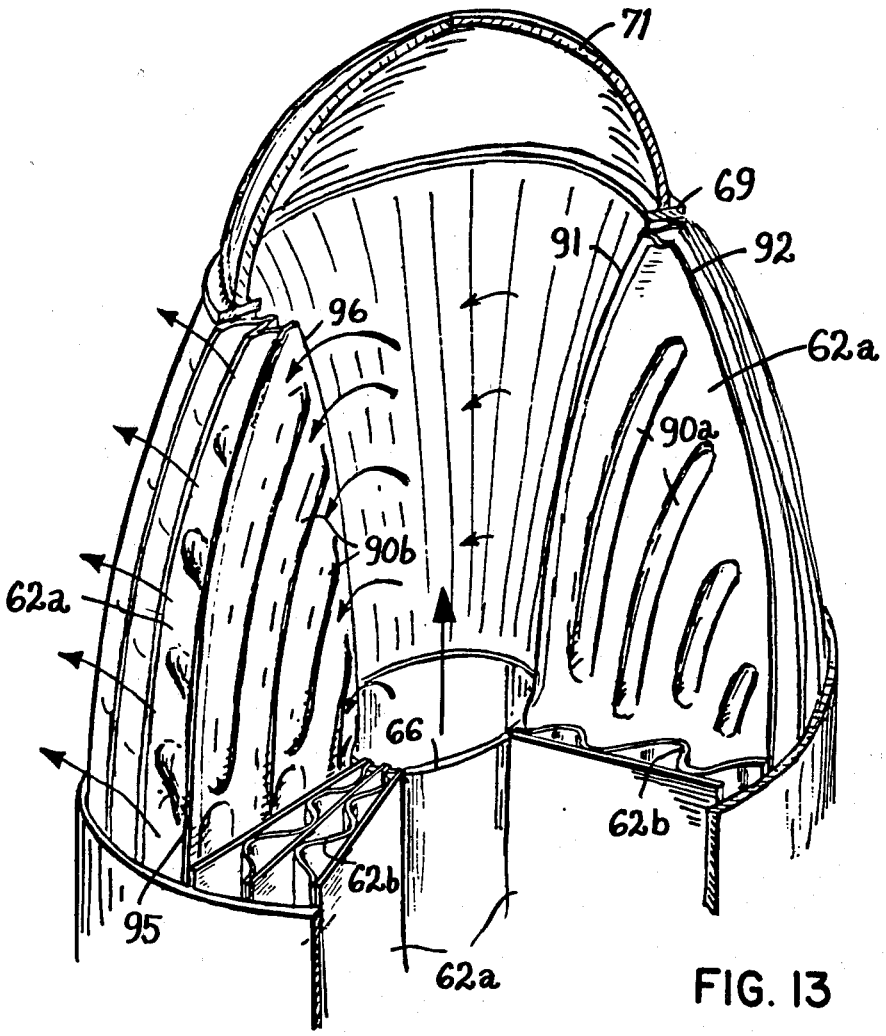
FIG. 13 illustrates a partial perspective view of an upper end of the heat exchanger of FIG. 5 in accordance with the invention.

FIG. 10 shows schematically the development of a wall 82*b*. The edge 91 faces the central portion of the exchanger element and extends, as indicated in FIGS. 9 and 8, at the height +H over its entire length, while the peripheral edge 92 is at the height 0 in the region B, but at the height −H in the region A. The dash-dotted line 93 depicts the profile in the region A, and a corresponding line 94, the profile in the region B (see also FIG. 13). The grooves 90*a* are curved outward with a spacing which increases in an outward direction, approximately in accordance with the shape of the edge 91 in the region B.

Figure 11:
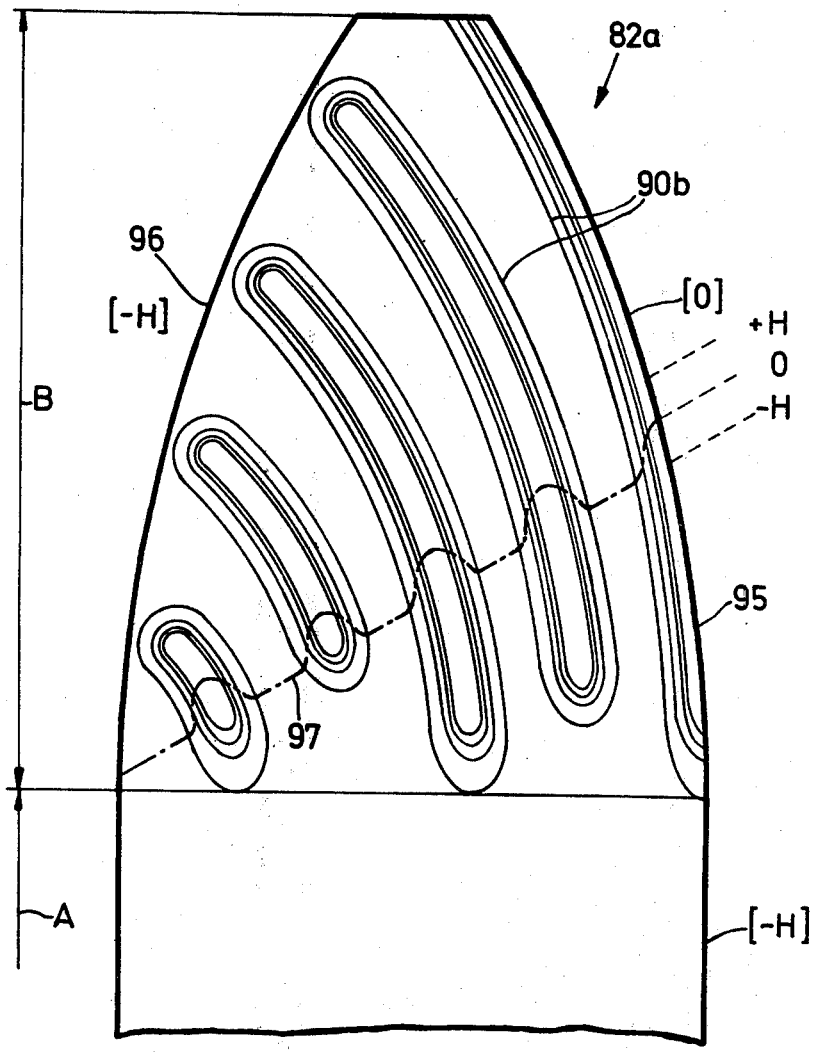

FIG. 11 shows, also in a schematic view, the development of a wall 82*a* following an involute as per FIG. 7. The wall 82*b* as per FIG. 10 comes to lie, when the star-shaped lamination package is assembled, on the wall 82*a*. The outer long edge 95 is at the level −H in the region A and at the level 0 in the region B, while the opposite long edge 96 is at the height −H over its entire length. The profile in the region B is indicated by the dash-dotted line 97; in the region A, the sheet metal wall 82*a* is plane at the height −H in accordance with FIG. 8. The grooves 90*b* are curved inward with a spacing which increases in an outward direction and are disposed approximately according to the edge 95.

Figure 14:
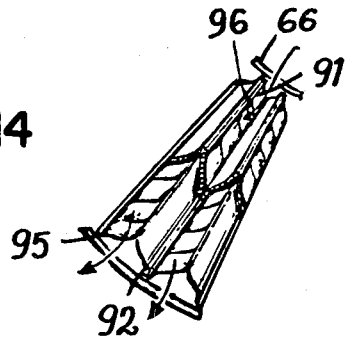
FIG. 14 illustrates a plan view of a section of the heat exchange element in accordance with the invention.

The edge 95 of the wall 82*a*(FIG. 11) and the edge 92 (FIG. 10) of the wall 82*b* have the same height pattern over the regions A, B and C. The walls can therefore be joined together in tight manner after being placed on each other. A ring corresponding to the ring 69 in FIG. 5, but not shown here is disposed at the end portions of the wall to form a tightly sealed connection at the end portions of the walls. On the inside, the edges 96 and 91 leave an open space, which enables one of the media to flow through in the regions B or C in the direction indicated by the arrows 77 and 78 in FIGS. 5 and 9. On the outside, the edges 92 and 95 leave an open space which enables the other medium to flow through in the regions B or C in the direction indicated by the arrows 75 and 74 (FIG. 14).

Figure 12:
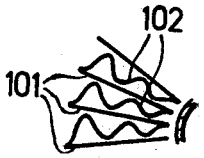
FIG. 12 illustrates a further embodiment of an exchanger element with corrugated walls in accordance with the invention.

The invention is not limited to the embodiment examples described so far. In particular, the corrugations of the radially disposed separating walls may be shaped differently from that explained in connection with FIGS. 5, 6 and 7. FIG. 12 shows corrugated separating walls 102 which are arranged between plane separating walls 101 and which are not braced, at least in the normal operation of the heat exchanger, against the walls 101 with their crests or troughs. Thus, contrary to the arrangement according to FIG. 6, flow zones for the media come about which are not subdivided into individual chambers. Furthermore, bump-like elevations, for instance, in the form of spherical sectors or hemispheres, may be provided in lieu of the grooves 90*a* and 90*b*.

Although the preferred field of application of the invention is aimed at the heat transfer between gaseous media, particularly in high-temperature reactors, the invention can also be used with the same advantages and effects for liquid media or for one liquid and one gaseous medium, which together participate in a heat exchange.

If the heat exchanger is used as a recuperator, the same medium can flow, with different temperatures and different pressures, at the primary and the secondary side of the heat exchanger.

What is claimed is:

1. In a heat exchanger having a longitudinally disposed tube for guiding one heat transfer medium therethrough, a heat exchanger element disposed coaxially of the tube, said element having a plurality of walls extending outwardly from a longitudinally disposed central area, each of said walls being connected at an inner radial end to an adjacent wall and at an outer radial end to another adjacent wall to define flow zones on opposite sides of each wall, at least every second one of said walls following each other in the circumferential direction of said heat exchanger element being corrugated and having crests running in the direction of the longitudinal axis of said heat exchanger element;

a flat wall disposed between two corrugated walls, said corrugated walls having respective crests and troughs braced against said flat walls; and means closing alternating flow zones to the remaining flow zones to form separate flow paths for two heat exchange media on opposite sides of each wall, said means defining an inlet for one heat exchange medium from the tube and an outlet for the other heat exchange medium to and from alternating flow zones at one longitudinal end of said element, and an outlet for the one heat exchange medium and an inlet for the other heat exchange medium from and to the alternating flow zones at the opposite longitudinal end of said element whereby the two heat exchange media flow in countercurrent through said element.

2. A heat exchanger as set forth in claim 1 wherein said flow zones expand radially outward and are disposed between two walls immediately following each other, said crests being of increasing wave height with increasing distance from said central area while the wave length of said crests decreases.

3. A heat exchanger as set forth in claim 1 wherein said walls are curved in involute-fashion with each pair of adjacent walls in the circumferential direction of said element enclosing over their entire extend flow zones which are of substantially the same geometrical character transverse to the longitudinal axis of said exchanger element.

4. A heat exchanger as set forth in claim 1 wherein said walls are of alternating patterns; one of said patterns having corrugations in a central portion of said exchanger element parallel to the axis which rise or fall alternatingly from a mean level 0 to the height +H and −H, said one pattern terminating on one long side at the height +H and on the other long side at the height −H and a plurality of elevations following said +H corrugations outside said central portion which rise exclusively from the level 0 to the height H, said other pattern being approximately plane in the region of said center portion at the height −H and has elevations which rise outside said central portion from the height −H to the height 0, said long sides of adjacent walls alternatingly joined together over their entire length to form a tight seal.

5. A heat exchanger as set forth in claim 4 wherein said elevations are formed by grooves.

6. A heat exchanger as set forth in claim 5 wherein said grooves of the corrugated wall run toward that long side which is lower than the other long side and said grooves in said other wall run toward the other long side whereby said grooves in adjacent spaces cross each other.

7. A heat exchanger as set forth in claim 6 which further comprises additional grooves between said grooves which run as a continuation of said crests of said corrugated wall and which rise between the heights 0 and +H.

8. A heat exchanger as set forth in claim 1 wherein said walls are cut in lancet-fashion outside a center portion of said heat exchanger element.

9. In a heat exchanger, the combination comprising a central tube for conveying a first heat exchange medium;

an outer tube coaxially of and spaced from said central tube to define an annular space;

a plurality of first walls having flat sections disposed in involute fashion in said annular space between said tubes;

a plurality of second walls having corrugated sections disposed in alternating relation with said flat sections of said first walls, each said corrugated wall having respective crests and troughs braced against respective flat walls and disposed longitudinally of said central tube to define flow zones; and means closing alternating flow zones to the remaining flow zones between each pair of adjacent flat walls to form separate counter flow paths, said means defining an inlet to alternating flow zones at one end of said walls communicating with said central tube to receive a flow of the first heat exchange medium therefrom and an outlet from said alternating flow zones at an opposite end of said walls to exhaust the flow of the first heat exchange medium, said means further defining an inlet at said opposite end to the remaining flow zones to receive a second heat exchange medium and an outlet at said one end to exhaust the second heat exchange medium from said remaining flow zones.

10. A heat exchanger comprising a central tube;

an outer tube coaxially of and spaced from said central tube to define an annular space;

a plurality of first walls having flat sections disposed in involute fashion in said annular space between said tubes;

a plurality of second walls having corrugated sections disposed in alternating relation with said flat sections of said first walls, each said corrugated wall having respective crests and troughs braced against respective flat walls and disposed longitudinally of said central tube to define flow zones;

each corrugated wall being connected to one adjacent flat wall on one side and connected to the other adjacent flat wall at the opposite side;

said walls extending beyond said tubes at each end thereof in lancet fashion with adjacent walls having elevations thereon disposed in mutually crossing relation whereby said flow zones open toward said central tube and said outer tube in alternating fashion to define an inlet to alternating flow zones at one end of said walls communicating with said central tube to receive a flow of the first heat exchange medium therefrom and an outlet from said alternating flow zones at an opposite end of said walls to exhaust the flow of the first heat exchange medium, while defining an inlet at said opposite end to the remaining flow zones to receive a second heat exchange medium and an outlet at said one end to exhaust the second heat exchange medium from said remaining flow zones.

11. In a heat exchanger, the combination comprising a central tube for conveying a first heat exchange medium;

a heat exchange element disposed about said tube, said element including a plurality of alternating flat walls and corrugated walls, said corrugated walls having crests and troughs extending longitudinally of said central tube to define alternating flow zones between each pair of adjacent flat walls, said walls extending beyond said tube at each end thereof in lancet fashion with adjacent walls having elevations thereon disposed in mutually crossing relation, each corrugated wall being connected to one adjacent flat wall on one side and connected to the other adjacent flat wall at the opposite side to define an inlet for the first heat exchange medium and an outlet for a second heat exchange medium to and from alternating flow zones at one lancet end of said heat exchange element and an outlet for the first heat exchange medium and an inlet for the second heat exchange medium from and to the alternating flow zones at the opposite lancet end of said heat exchange element;

a spherical section secured to said one lancet end to direct the first heat exchange medium from said central tube into alternating flow zones of said heat exchange element; and an outer connecting tube disposed about said central tube and connected to the opposite lancet end to define an annular space for exhausting the first heat exchange medium from said heat exchange element.

* * * * *

UNITED STATES PATENT AND TRADEMARK OFFICE

CERTIFICATE OF CORRECTION

PATENT NO. : 4,178,991

DATED : December 18, 1979

INVENTOR(S) : Hans Bieri

It is certified that error appears in the above-identified patent and that said Letters Patent are hereby corrected as shown below:

Column 1, line 26, change "extent" to --extend--

Column 2, line 53, change "alternatiingly" to --alternatingly--

Column 4, line 18, change "and" to --are--

Column 4, line 33, change "wall" to --walls--

Column 6, line 22, after "B" delete --(see also Fig. 13)--

Column 6, line 26, after "B" insert --(see also Fig. 13)--

Signed and Sealed this

*Twenty-fifth* Day of *March 1980*

[SEAL]

*Attest:*

SIDNEY A. DIAMOND

*Attesting Officer*

*Commissioner of Patents and Trademarks*